US007039353B2

(12) United States Patent
Yamada et al.

(10) Patent No.: US 7,039,353 B2
(45) Date of Patent: May 2, 2006

(54) IMAGE FORMING APPARATUS, REPLACEMENT UNIT AND CLEANER

(75) Inventors: Masatomo Yamada, Saitama (JP); Masaki Suda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/888,589

(22) Filed: Jul. 12, 2004

(65) Prior Publication Data

US 2005/0084282 A1 Apr. 21, 2005

(30) Foreign Application Priority Data

Oct. 17, 2003 (JP) ..... P2003-357159

(51) Int. Cl.
*G03G 21/00* (2006.01)

(52) U.S. Cl. ..... 399/349; 399/101; 399/297

(58) Field of Classification Search ..... 399/111, 399/297, 302, 308, 343–360
See application file for complete search history.

(56) References Cited

U.S. PATENT DOCUMENTS 6,347,212 B1 * 2/2002 Kosugi et al. ..... 399/348
2003/0219287 A1 * 11/2003 Ogiyama et al. ..... 399/297
2004/0096239 A1 * 5/2004 Hosokawa et al. ..... 399/111

FOREIGN PATENT DOCUMENTS

| | | |
|---|---|---|
| JP | 3-220571 | 9/1991 |
| JP | 8-328348 | 12/1996 |
| JP | 2001-175077 | 6/2001 |
| JP | 2002-341706 | 11/2002 |
| JP | 2003-098839 | 4/2003 |

* cited by examiner

*Primary Examiner*—Quana Grainger
(74) *Attorney, Agent, or Firm*—Morgan, Lewis & Bockius, LLP

(57) ABSTRACT

An image forming apparatus includes an intermediate transfer member having at least one short surface and two elongated surfaces and held so as to be substantially a flat shape, and an intermediate transfer member cleaner provided on the short surface of the intermediate transfer member for removing toner attached to the surface of the intermediate transfer member. The intermedaite transfer member cleaner includes a scraper provided on the upstream side of the intermediate transfer member in the direction of rotation and a brash roller 86 provided on the downstream side in the direction of rotation.

6 Claims, 4 Drawing Sheets

IMAGE FORMING APPARATUS, REPLACEMENT UNIT AND CLEANER

BACKGROUND OF THE INVENTION

1. Field of the invention

The present invention relates to an image forming apparatus of a type which carries toner on a belt-shaped member.

2. Description of the Related Art

For example, JP-A-2003-098839 discloses a cleaning device having a plurality of cleaning rollers and generating cleaning electric field which enables residual toner of different polarities to be adsorbed on these cleaning rollers. JP-A-2001-175077 and Patent JP-A-2002-341706 discloses a intermediate transfer member formed substantially into a square shape, and JP-A-8-328348 discloses a transfer belt formed substantially into a triangular shape. JP-A-3-220571 discloses a color image forming apparatus in which a cleaning device is disposed at the end of a photoreceptive belt formed substantially into a flat shape.

SUMMARY OF THE INVENTION

In view of such circumstances, it is an object of the present invention to provide an image forming apparatus which is reduced in size while maintaining the efficiency for cleaning toner attached on the belt-shaped member.

In order to achieve the object described above, an image forming apparatus according to the present invention includes an image forming apparatus including an image carrying member which is formed substantially into a flat shape and includes at least one short surface and two elongated surfaces, and a cleaner which is provided on the short surface of the image carrying member and removes toner attached to the surface of the image carrying member.

Preferably, an image forming apparatus further includes a storage medium and a transfer device which transfers a toner image to the storage medium, in which the image carrying member includes a first short surface and a second short surface, the first short surface is opposed to the second short surface, the first short surface is provided with the transfer device, and the second short surface is provided with the cleaner.

Preferably, the second short surface is formed substantially in a vertical direction.

Preferbly, the cleaner includes a first cleaning unit which hass a plate-shaped member and a second cleaning unit which has a roller, the image carrying member rotates in a constant direction, and the second cleaning unit is disposed downstream of the first cleaning unit in the constant direction of rotation of the image carrying member.

Preferably, the short surface-formed by the image carrying member is supported by at least two supporting rollers, the first cleaning unit opposes to a first supporting roller provided on an upstream side in the direction of rotation of the image carrying member, and the second cleaning unit opposes to a second supporting roller provided on the downstream side in the direction of rotation of the image carrying member.

Preferably, a bias voltage having a opposite polarity to that of toner is applied on at least one of the first cleaning unit and the second cleaning unit.

A replacing unit according to the present invention includes an image carrying member, a cleaner removing toner attached on a surface of the image carrying member, in which the image carrying member comprises a belt-shaped member including at least one short surface and two elongated surfaces held so as to be substantially a flat shape, and the cleaner is provided on the short surface of the belt-shaped member.

A cleaner, according to the present invention, carried by an image carrying member includes a first cleaning unit which is provided on a substantially flat portion of the image carrying member and performs a first toner removal process; and a second cleaning unit which is disposed on a substantially flat portion of the image carrying member and downstream of the first cleaning unit and performs a second toner removal process.

According to the image forming apparatus of the present invention, the apparatus can be reduced in size while maintaining the efficiency for cleaning toner attached on the belt-shaped member.

DETAILED DESCRIPTION OF THE PREFFERED EMBODIMENTS

A first embodiment of the present invention will be described below.

Figure 1:
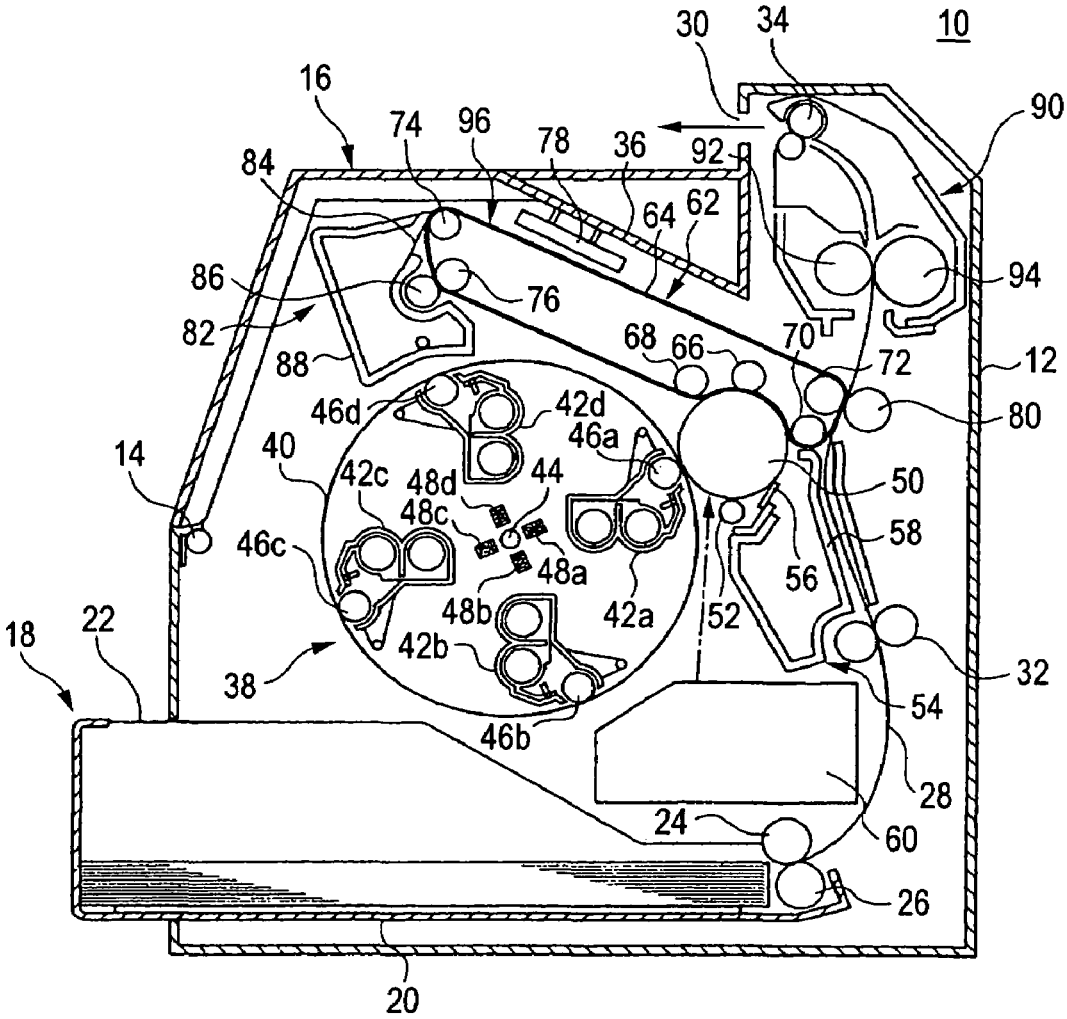
FIG. 1, is a general configuration of an image forming apparatus according to an embodiment of the present invention.

FIG. 1 shows a general configuration of an image forming apparatus 10 according to the embodiment of the present invention. The image forming apparatus 10 according to the present embodiment includes an image forming apparatus body 12, a rotatably opening-closing cover 16 provided on top of the image forming apparatus body 12 about a center of rotation 14, and, for example, a single-stage paper feed unit 18 at the bottom of the image forming apparatus 12.

The paper feed unit 18 includes a paper feed unit body 20, and a paper feed cassette 22 in which sheets are stored. A feed roller 24 for feeding the sheets from the paper feed cassette 22 and a retard roller 26 for separating sheets to be supplied into individual sheet.

A feed passage 28 is a sheet passage extending from the feed roller 24 to a discharge port 30, and the feed passage 28 is disposed in the vicinity of the back side (right side in FIG. 1) of the image forming apparatus body 12, and is formed substantially vertically from the paper feed unit 18 to a fixing unit 90, that will be described later. A secondary transfer roller 80 and a secondary transfer backup roller 72, described later, are disposed upstream of the fixing unit 90 on the feed passage 28, and a resist roller 32 is disposed on upstream of the secondary transfer roller 80 and the secondary transfer backup roller 72. A discharge roller 34 is provided in the vicinity of the discharge port 30 of the feed passage 28.

Therefore, the sheets supplied from the paper feed cassette 22 of the paper feed unit 18 by the feed roller 24 are separated into individual sheet by the retard roller 26. Then, only the uppermost sheet is guided to the feed passage 28, is stopped temporarily by the resist roller 32, and is passed at an adequate timing between the secondary transfer roller 80 and the secondary transfer backup roller 72, described later, where the toner image is transferred. Subsequently, the transferred toner image is fixed by the fixing unit 90 and is discharged from the discharge port 30 to a discharge section 36 provided on top of the opening-and-closing cover 16 by the discharge roller 34. The discharge section 36 is low at the position where the discharge port is present, and inclines gradually upward toward the front (leftward in FIG. 1).

The image forming device body 12 is provided with a rotary developer 38 disposed, for example, substantially at the center. The rotary developer 38 includes developers 42*a*–42*d* for forming the toner images of four colors of yellow, magenta, cyan, and black individually in a developer body 40, and rotates leftward about a center 44 of the rotary developer (counterclockwise in FIG. 1). The developers 42*a*–42*d* respectively include developing rollers 46*a*–46*d*, and is pressed in the direction of normal line of the developer body 40 due to resilient members 48*a*–48*d* such as coil springs.

The rotary developer 38 is provided with a photoreceptor 50 so as to abut thereto, and parts of the outer peripheries of the respective developing rollers 46*a*–46*d* project about, for example, 2 mm in the radial direction from the outer periphery of the developer body 40 in a state of not being in abutment with the photoreceptor 50. At both ends of the developing rollers 46*a*–46*d*, there are provided tracking rollers (not shown) having a diameter slightly larger than the diameter of the developing rollers 46*a*–46*d* so as to rotate coaxially with the developing rollers 46*a*–46*d*. In other words, the developing rollers 46*a*–46*d* of the developers 42*a*–42*d* are disposed on the outer periphery of the developer body 40 at intervals of 90° about the center 44 of the rotary developer respectively, and the tracking rollers of the developing rollers 46*a*–46*d* abut against flanges (not shown) provided at both ends of the photoreceptor 50, and develop a latent image on the photoreceptor 50 with toners of the respective colors while generating predetermined gaps between the developing rollers 46*a*–46*d* and the photoreceptor 50.

A charging device 52 formed, for example, of a charging roller for charging the photoreceptor 50 uniformly is provided below the photoreceptor 50. An image carrying member cleaner 54 abuts against the photoreceptor 50 on the upstream side of the charging device 52 in the direction of rotation of the photoreceptor 50. The image carrying member cleaner 54 includes, for example, a cleaning blade 56 for scraping residual toner on the photoreceptor 50 after the primary transfer, and a toner collecting bottle 58 for collecting toner scraped by the cleaning blade 56.

On the back side (right side in FIG. 1) of the toner collecting bottle 58, there is formed, for example, a rib formed into a curved surface to allow the sheets to be fed smoothly, and defines the feed passage 28.

An exposure device 60 for writing a latent image on the photoreceptor 50 charged by the charging device 52 by a beam such as a laser beam is provided downwardly of the rotary developer 38. Above the rotary developer 38, there is provided an intermediate transfer device 62 for effecting primary transfer of a toner image visualized by the rotary developer 38 at a primary transferring position, and then transferring it to the secondary transferring position described later.

The intermediate transfer device 62 includes, for example, an intermediate transfer member 64 (image carrying member) such as an intermediate transfer belt, a primary transfer roller 66, a wrap-in roller 68, a wrap-out roller 70, a secondary transfer backup roller 72, a scraper backup roller 74, and a brush backup roller 76. Although the intermediate transfer member 64 is described as an example of the image carrying member in the present embodiment, it is not limited thereto, and the image carrying member according to the present invention also includes the photoreceptor 50 and the like.

The intermediate transfer member 64 has resiliency, for example, and is extended substantially in a flat shape at the position above the rotary developer 38 so as to have a first elongated surface 64*a*, a second elongated surface 64*c*, a first short surface 64*b*, and a second short surface 64*d*. The intermediate transfer member 64 includes an image carrying member wrapping area which abuts against the photoreceptor 50 in a wrapped manner between the wrap-in roller 68 disposed below the elongated surface (second elongated surface 64*c*) of the intermediate transfer member 64 on the upstream of the primary transfer roller 66, and wrap-out roller 70 disposed downstream of the primary transfer roller 66, and the wrap around the photoreceptor 50 by a predetermined range and follow the rotation of the photoreceptor 50. In this manner, the intermediate transfer member 64 effects a toner image on the photoreceptor 50, which is transferred by the primary transfer roller 66 via primary transfer, so as to be overlapped in the sequence of, for example, yellow, magenta, cyan, and black, and the toner image, to the secondary transfer roller 80, described later.

The wrap-in roller 68 and the wrap-out roller 70 are located apart from the photoreceptor 50.

Further, on the back side (right side in FIG. 1) of the intermediate transfer member 64, there is formed a flat portion (that is, the first short surface 64*d*) by the wrap-out roller 70 and the secondary transfer backup roller 72, and the first short surface 64*d* faces the feed passage 28 as a second transfer section.

In the second transfer section, the wrap-out roller 70 is disposed so that the angle between the intermediate transfer member 64 and the feed passage 28 becomes for example 12°.

On the front side (left side in FIG. 1) of the intermediate transfer member 64, a substantially vertical flat portion (that is, the second short surface 64*b*) is formed by the scraper backup roller 74 (a supporting roller disposed on the upstream side of the intermediate transfer member 64 in the direction of rotation thereof) and the brash backup roller 76 (a supporting roller disposed on the downstream side of the intermediate transfer member 64 in the direction of rotation thereof). More specifically, the scraper backup roller 74 is positioned at the front side (left side in FIG. 1) of the brush backup roller 76. Therefore, the second short surface 64*b* is slightly overhung from the vertical position and the outer peripheral surface is faced downward. The scraper backup roller 74 is positioned at the higher level than a heating roller 92 and a pressurizing roller 94, described later, and at the lower level than the discharge roller 34. Therefore, the intermediate transfer device 62 is inclined and the second short surface 64*b* is positioned at the higher level than the first short surface 64*d*.

The scraper backup roller 74 helps a scraper 84, described later, to scrape residual toner on the intermediate transfer member 64 after the secondary transfer, and the brush backup roller 76 helps a brush roller 86, described later, to scrape residual toner on the intermediate transfer member 64 after the secondary transfer.

Above the elongated side (first elongated surface 64*a*) of the intermediate transfer member 64, a sensor 78 such as a reflection photo sensor is provided by being fixed on the back surface (inner side) of the opening-and-closing cover 16. The sensor 78 reads a patch of toner formed on the intermediate transfer member 64, detects the position of the intermediate transfer member 64 in the direction of rotation thereof, and detects the concentration of toner.

Opposed to the secondary transfer backup roller 72 of the intermediate transfer member 62 is the secondary transfer roller 80 with the intermediary of the feed passage 28. In other words, the portion between the secondary transfer roller 80 and the secondary transfer backup roller 72 is the secondary transfer position in the secondary transfer section, and the secondary transfer roller 80 transfers the toner image transferred to the intermediate transfer member 64 via the primary transfer to a sheet at the secondary transfer position via the secondary transfer by the assist of the secondary transfer backup roller 72. The secondary transfer roller 80 is positioned apart from the intermediate transfer member 64 while the intermediate transfer member 64 makes three turns, that is, while three toner images of three colors of yellow, magenta, and cyan are transfered, and is brought into abutment with the intermediate transfer member 64 after having transferred the black toner image. The portion between the secondary transfer roller 80 and the secondary transfer backup roller 72 are adapted to generate a predetermined difference in potential, and the secondary transfer backup roller 72 is connected, for example, to a ground (GND) when the secondary backup roller 80 is set to a high voltage.

On the opposite side of the intermediate transfer device 62 from the secondary transfer position, an intermediate cleaner 82 (cleaner) abuts against the second short surface 64*b*. The intermediate transfer cleaner 82 includes, for example, the scraper 84 (first cleaning means) for scraping and cleaning residual toner on the intermediate transfer member after the secondary transfer, the brush roller 86 (second cleaning means) for further scraping residual toner after cleaning by the scraper 84, and a toner collecting bottle 88 for collecting toner scraped by the scraper 84 and the brush roller 86. The scraper 84 is formed, for example, of a stainless thin plate, and a predetermined voltage is applied thereto. The brush roller 86 is formed, for example, of a brush of acryl or the like, to which conductivity is provided. In this manner, by providing the intermediate transfer member cleaner 82 so as to abut against the substantially vertical second short surface 64*b*, toner scraped by the scraper 84 and the brush roller 86 is collected in the toner collecting bottle 88 by its own weight. In other words, by disposing the intermediate transfer member cleaner 82 at the position opposing to substantially vertically formed second short surface 64*b*, a transporting mechanism for transporting scraped toner is not necessary, and hence downsizing of the apparatus is achieved.

Furthermore, the scraper 84 and the brush roller 86 are adapted to be positioned apart from the intermediate transfer member 64 while the intermediate transfer member 64 transfers the toner image, and to be brought into abutment integrally against the intermediate transfer member 64 at predetermined timings.

Provided above the secondary transfer position is the fixing unit 90. The fixing unit 90 includes the heating roller 92 and the pressurizing roller 94, the secondary transfer roller 80 and the secondary transfer backup roller 72 fix the toner image transfered via the secondary transfer to the sheet, and transfer the sheet toward the discharge roller 34.

An image forming unit 96 includes the intermedaite transfer device 62, the photoreceptor 50, the charging device 52, the image carrying member cleaner 54, and the intermediate transfer member cleaner 82 integrated together. The image forming unit 96 is disposed immediately below the discharge section 36 of the opening-and-closing cover 16, and, for example, the intermediate transfer member 62 is disposed between the rotary developer 38 and the fixing unit 90 and is attached and detached by opening the opening-and-closing cover 16. In this example, since the intermediate transfer cleaner 82 is disposed at the position opposing to the second short surface 64*b* of the intermediate transfer device 62, the image forming unit 96 is formed as a thin replacing unit curved along the curved surface of the rotary developer 64.

Subsequently, the operation of the embodiment described above will be described.

When an image forming signal is emitted, the photoreceptor 50 is uniformely charged by the charging device, and a light beam is emitted from the exposure device 60 to the charged photoreceptor 50 based on the image signal. The light beam from the exposure device 60 exposes the surface of the photoreceptor 50 and the latent image is formed. The latent image of the photoreceptor 50 formed by the exposure device 60 is developed by the rotary developer 38 with toners of yellow, magenta, cyen, and black, which are overlaped on the intermediate transfer member 64 via the first transfer. Residual wasted toner on the photoreceptor 50 after the primary transfer is scraped by the image carrying member cleaner 54 and collected.

On the other hand, the sheets stored in the paper feed cassette 22 are supplied by the feed roller 24, separated into individual sheet by the retard roller 26, guided to the feed passage 28, stopped temporarily by the resist roller 32, and guided at an adequate timing between the secondary transfer roller 80 and the secondary transfer backup roller 72. When the sheet is guided between the secondary transfer roller 80 and the secondary transfer backup roller 72, the toner image transferred on the intermediate transfer member 64 via the primary transfer is transferred to the sheet by the secondary transfer roller 80 and the secondary transfer backup roller 72 via the secondary-transfer. After the secondary transfer, residual wasted toner on the intermediate transfer member 64 is scraped by the intermediate transfer member cleaner 82 and collected.

The sheet having the toner image transferred thereon passes an opening and is guided to the fixing unit 90, where the toner image is fixed by heat pressure by the heating roller 92 and the pressurizing roller 94 thereon. The sheet having the toner image fixed thereon is discharted by the discharge roller 34 to the discharging section 36 from the discharge port 30.

Figure 2:
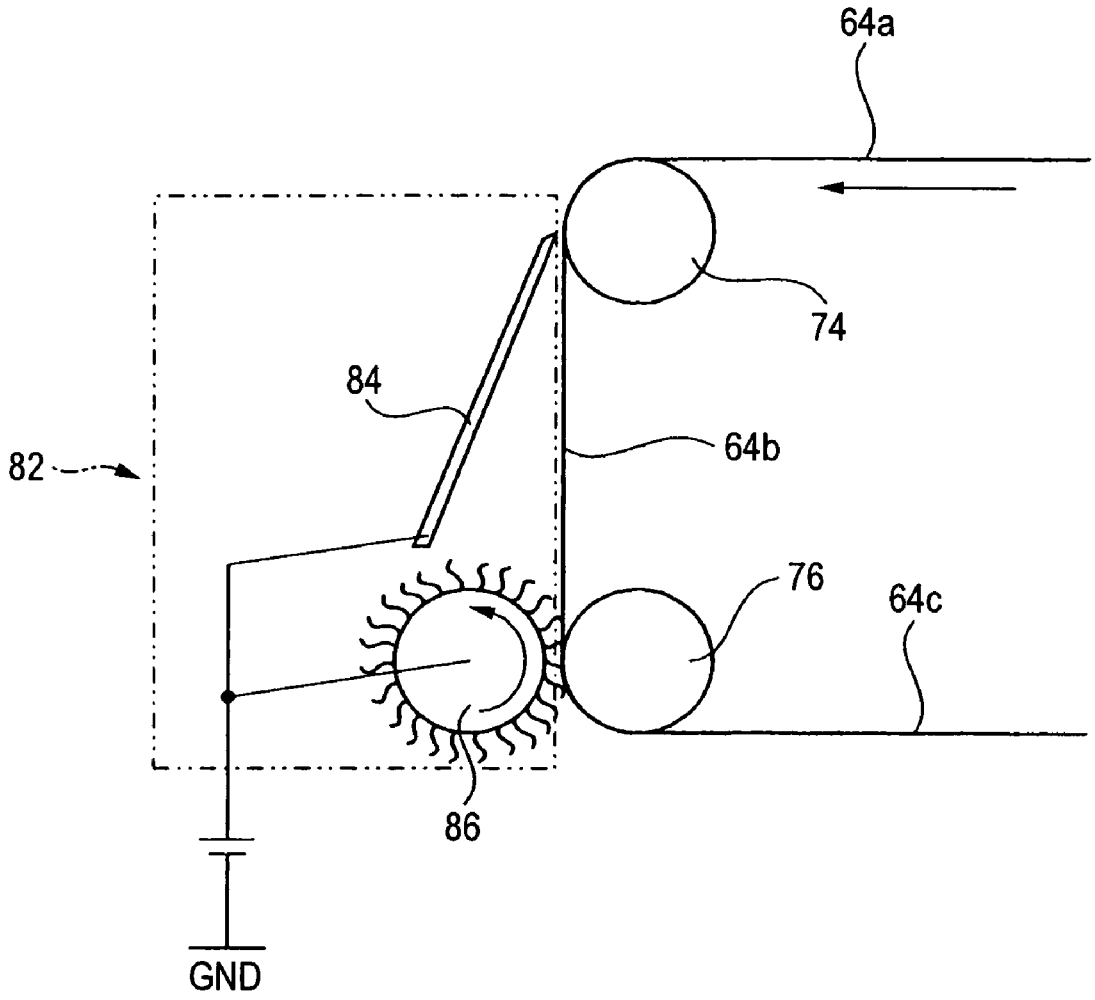
FIG. 2 is a drawing schematically showing an intermediate transfer member cleaner.

In FIG. 2, the intermediate transfer member cleaner 82 is schematically shown. The first elongated surface 64*a* and the second elongated surface 64*c* of the intermediate transfer member 64 are formed so as to oppose to each other, and direct their toner carrying surfaces toward above and below the image forming apparatus 10, respectively. The first short surface 64*d* (not shown) and the second short surface 64*b* are formed so as to oppose to each other, and the first short surface 6*t*4*d* is used as the transfer position of the onter image, and the second short surface 64*b* is used as the position where residual toner is removed.

Therefore, the intermediate transfer member cleaner 82 is disposed at the position opposing to the second short surface 64*b*, and abuts against the short surface 64*b* of the intermediate transfer member 64 when removing toner.

The scraper 84 is formed of a thin plate-shaped member, and a bias voltage, which has an opposite polarity from toner, is applied thereto. When the intermediate transfer member cleaner 82 abuts against the intermediate transfer member 64, the scraper 84 abuts against the intermediate transfer member 64 at the position opposing to the scraper backup roller 72, and scrapes toner attached on the surface of the intermediate transfer member 64 by the distal portion thereof. Therefore, the scraper 84 can scrape toner accumulated on the intermediate transfer member 64 efficiently.

The brush roller 86 is rotatably provided and is formed with a far brush having a charging property at the surface thereof. When the intermediate transfer member cleaner 82 abuts against the intermediate transfer member 64, the brush roller 86 abuts against the intermediate transfer member 64 at the position opposing to the brush backup roller 76, and rotates in the direction being adverse to the rotation of the intermediate transfer member 64. The brush formed on the surface of the brush roller 89 scrapes toner attached on the surface of the intermediate transfer member 64 according to the rotation of the brush roller 66. The brush roller 86 may be a conductive roller which does not have a brush structure.

The brush roller 86 abuts against the second short surface 64*b* of the intermediate transfer member 64 on the downstream side of the scraper 84. Accordingly, toner attached on the intermediate transfer member 64 is scraped mainly at the portion where it is accumulated by the scraper 84 into a thin layer, and then toner which has become a tin layer is scraped by the brush roller 86.

Figure 3B:
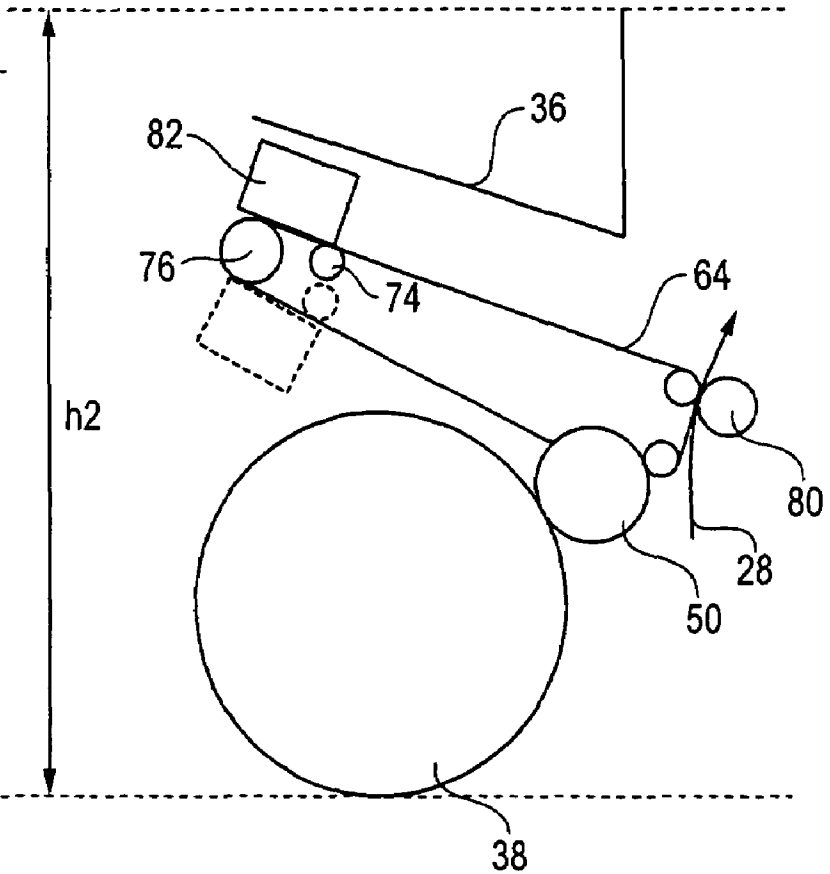
FIGS. 3A and 3B show the position of the intermediate transfer member cleaner in the case where a second short surface is formed and the position of the intermediate transfer member cleaner 82 in the case where the second short surface is not formed.
Figure 3A:
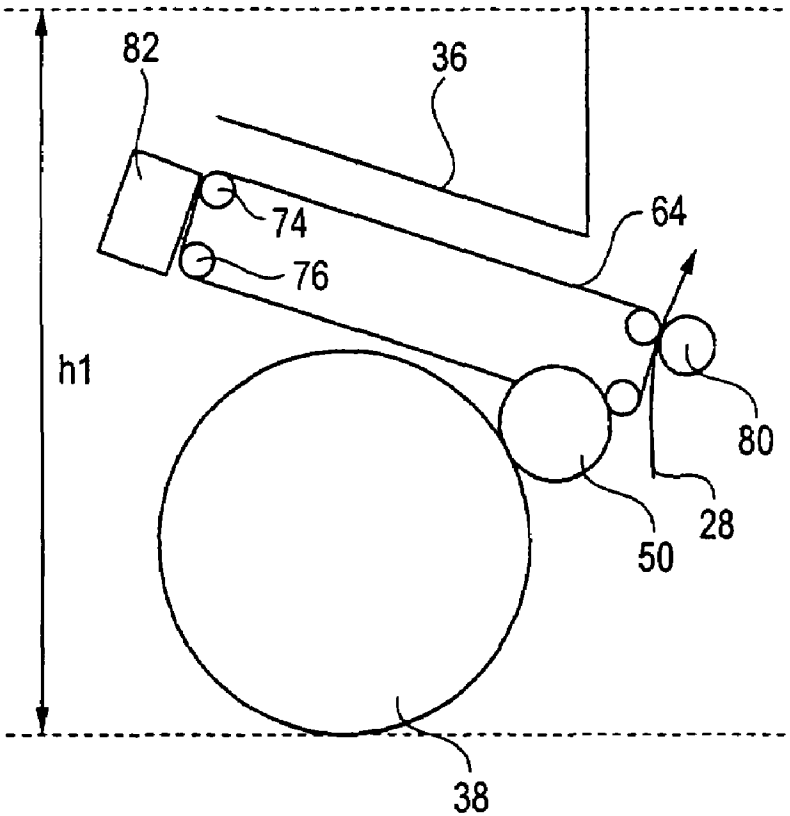

In FIG. 3, the position of the intermediate transfer member cleaner 82 where the second short surface 64*b* is formed and the position of the intermediate transfer member cleaner 82 where the second short surface 64*b* is not formed are shown. When downsizing the image forming apparatus 10, it is necessary to lower the position of the fixing member 90 as much as possible. Therefore, as shown in FIG. 3A and FIG. 3B, it is necessary to lower the first short surface 64*d*, which is the second transfer position. Then, the intermediate transfer member 64 which is substantially flat is inclined so that the front side (left side in FIG. 3A and FIG. 3B) is positioned at the higher level, correspondingly.

As shown in FIG. 3A, when the second short surface 64*b* having dimensions required for cleaning of toner is formed, the intermediate transfer member cleaner 82 may be disposed at the position opposing to the second short surface 64*b*.

On the other hand, as shown in FIG. 3B, when the second short surface 64*b* is not formed, it is possible to dispose the intermediate transfer member cleaner 82 on any elongated surface. In this case, it is necessary to position the image forming apparatus body 12 at a higher level than the case shown in FIG. 3A. In other words, the intermediate transfer member 64 is substantially flat is provided on the short surface, and the intermediate transfer member cleaner 82 is disposed at the position opposing to the short surface, so that downsizing of the image forming apparatus body is achieved.

As described above, the image forming apparatus 10 in the present embodiment can increase the efficiency of removal of toner attached to the intermediate transfer member 64, and the height of the entire apparatus can be reduced.

Although the intermediate transfer member 64 provided with the two elongated surface and the two short surfaces are disposed at the positions opposing to each other has been described thus far in the embodiment described above, it is not limited thereto, and, for example, the intermediate transfer member 64 may be a substantially triangular flat shape.

Figure 4:
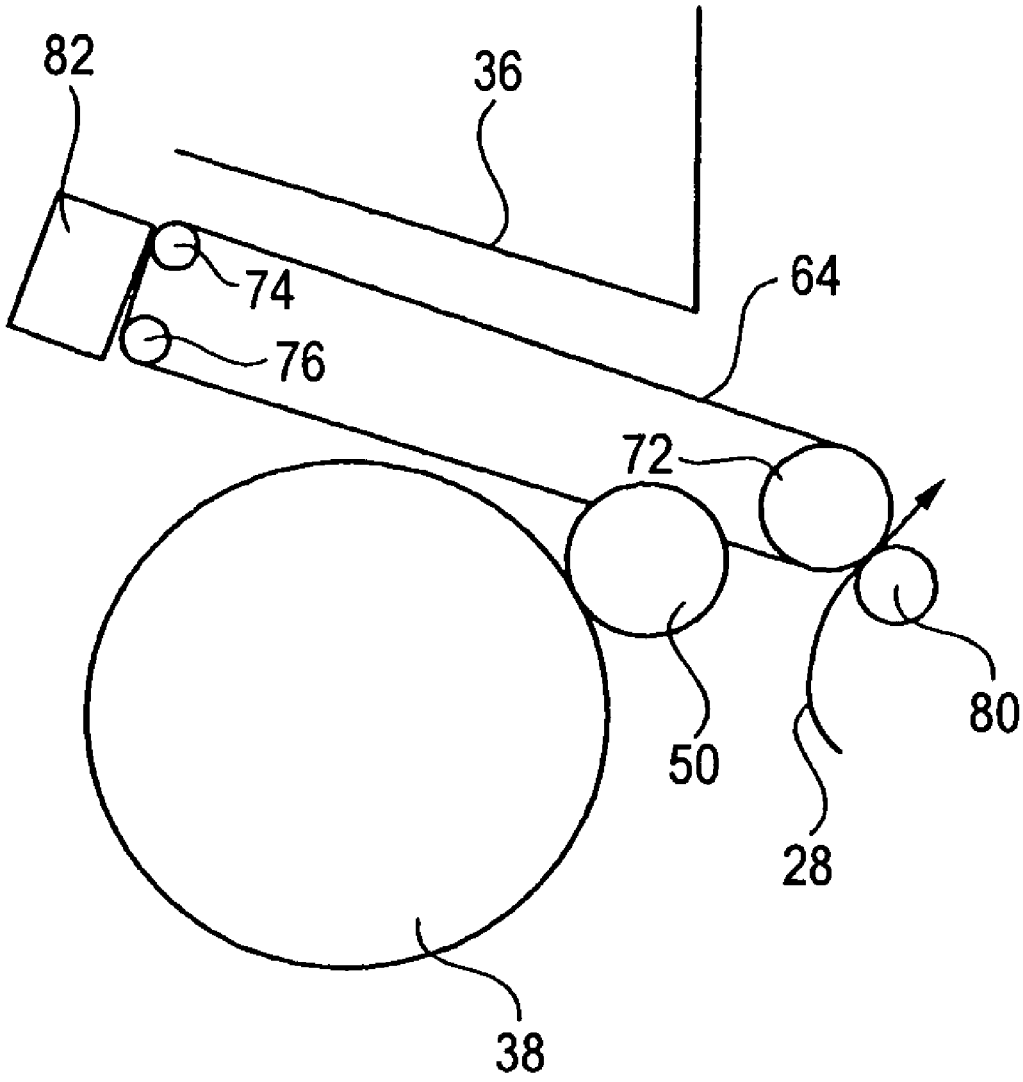
FIG. 4 is a drawing schematically showing an intermediate transfer member formed substantially into a triangle shape.

In FIG. 4, the intermediate transfer member 64 formed into a substantially triangular shape is shown. The intermediate transfer member 64 is formed substantially into a flat triangular shape by the secondary transfer backup roller 72, the scraper backup roller 74 and the brush backup roller 76. In this manner, even when the first short surface 64*d* is not formed, the height of the image forming apparatus body 12 can be reduced by directing the intermediate transfer member body cleaner 82 so as to oppose to the short surface of the intermediate transfer member 64. In this case, it is necessary to make the secondary transfer backup roller 72 about the same size as the photoreceptor 50 in order to form the secondary transfer section. Also, since the sheet has to enter at an angle of about 12° with respect to the secondary transfer section formed by the secondary transfer backup roller 72 and the secondary transfer roller, the feed passage 28 is curved.

What is claimed is:

1. An image forming apparatus comprising:

an image carrying member which is formed substantially into a flat shape and includes at least one short surface and two elongated surfaces, and a cleaner which is provided on the short surface of the image carrying member and removes toner attached to the surface of the image carrying member, wherein the cleaner comprises a first cleaning unit including a plate-shaped member and a second cleaning unit, the image carrying member rotates in a constant direction, and the second cleaning unit is disposed downstream of the first cleaning unit in the constant direction of rotation of the image carrying member, and wherein the short surface formed by the image carrying member is supported by at least two supporting rollers, the first cleaning unit opposes to a first supporting roller provided on an upstream side in the direction of rotation of the image carrying member, and the second cleaning unit includes a brush roller that opposes to a second supporting roller provided on the downstream side in the direction of rotation of the image carrying member.

2. The image forming apparatus according to claim 1, further comprising:

a storage medium; and a transfer device which transfers a toner image to the storage medium, wherein the image carrying member comprises a first short surface and a second short surface, the first short surface is opposed to the second short surface, the first short surface is provided with the transfer device, and the second short surface is provided with the cleaner.

3. The image forming apparatus according to claim 2, wherein the second short surface is formed substantially in a vertical direction.

4. The image forming apparatus according to claim 1, wherein a bias voltage having a opposite polarity to that of toner is applied on at least one of the first cleaning unit and the second cleaning unit.

5. A replacing unit comprising:

an image carrying member;

a cleaner removing toner attached on a surface of the image carrying member; and wherein the image carrying member comprises a belt-shaped member including at least one short surface and two elongated surfaces held so as to be substantially a flat shape, and the cleaner is provided on the short surface of the belt-shaped member, wherein the short surface formed by the image carrying member is supported by at least two supporting rollers, a first supporting roller provided on an upstream side in the direction of rotation of the image carrying member, and the cleaner includes a brush roller that opposes to a second supporting roller provided on the downstream side in the direction of rotation of the image carrying member.

6. A cleaner toner removing toner carried by an image carrying member, comprising:

a first cleaning unit which is provided on a substantially flat portion of the image carrying member and performs a first toner removal process; and a second cleaning unit which is disposed on a substantially flat portion of the image carrying member and downstream of the first cleaning unit and performs a second toner removal process, wherein a short surface is formed substantially in a vertical direction by the image carrying member and is supported by at least two supporting rollers, the first cleaning unit opposes to a first supporting roller provided on an upstream side in the direction of rotation of the image carrying member, and the second cleaning unit includes a brush roller that opposes to a second supporting roller provided on the downstream side in the direction of rotation of the image carrying member.

* * * * *